US006184742B1

(12) United States Patent
Mulder et al.

(10) Patent No.: US 6,184,742 B1
(45) **Date of Patent: *Feb. 6, 2001**

(54) CURRENT DISTRIBUTION CIRCUIT HAVING AN ADDITIONAL PARALLEL DC-CURRENT SINKING BRANCH

(75) Inventors: Jacob Mulder; Fransiscus J. M. Thus, both of Eindhoven (NL); Eric C. Labbe, Cornaredo (IT)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/077,137

(22) PCT Filed: Sep. 26, 1997

(86) PCT No.: PCT/IB97/01174

§ 371 Date: May 21, 1998

§ 102(e) Date: May 21, 1998

(87) PCT Pub. No.: WO98/13978

PCT Pub. Date: Apr. 2, 1998

(30) Foreign Application Priority Data

Sep. 26, 1997 (EP) ..... 96202693

(51) Int. Cl.[7] ..... G05F 1/10

(52) U.S. Cl. ..... 327/538; 323/315

(58) Field of Search ..... 327/546, 538, 327/539, 540, 541, 108; 323/277, 312, 315; 361/101

(56) References Cited

U.S. PATENT DOCUMENTS

| | | | | |
|---|---|---|---|---|
| 4,338,646 | * | 7/1982 | Davis et al. | 361/18 |
| 4,779,062 | * | 10/1988 | Scheraga | 330/298 |
| 4,860,154 | * | 8/1989 | Fazlollahi | 361/101 |
| 5,059,890 | * | 10/1991 | Yoshikawa et al. | 323/315 |
| 5,289,109 | * | 2/1994 | Summe | 323/265 |
| 5,343,141 | * | 8/1994 | Metro et al. | 323/288 |
| 5,428,287 | * | 6/1995 | Agiman | 323/284 |
| 5,491,401 | * | 2/1996 | Inoue et al. | 323/273 |
| 5,570,060 | * | 10/1996 | Edwards | 327/541 |
| 5,587,655 | * | 12/1996 | Oyabe et al. | 323/312 |
| 5,661,395 | * | 8/1997 | Johnson et al. | 323/273 |

* cited by examiner

*Primary Examiner*—Timothy P. Callahan
*Assistant Examiner*—Hai L. Nguyen

(57) ABSTRACT

A current distribution circuit for application in a communication device, such as a telephone subscriber circuit comprises a first current sinking branch, which is connected in parallel to a second current sinking branch. Both branches sink at least the DC current on the telephone line, whereas an excess current in the DC line is taken up by the second current sinking branch, which is provided with a current sinking transistor, whose collector/emitter voltage is relatively large. This leads to a reduced effectively needed chip area. The DC line-current can be measured by means of a low pass filter, preferable connected to a current mirror means.

16 Claims, 2 Drawing Sheets

CURRENT DISTRIBUTION CIRCUIT HAVING AN ADDITIONAL PARALLEL DC-CURRENT SINKING BRANCH

BACKGROUND OF THE INVENTION

The present invention concerns a current distribution circuit comprising:

a first at least DC current sinking branch, which is provided with the main current stream of a first controlled semiconductor having a first control input, a second current sinking branch connected in parallel to the series arrangement of the first current sinking branch, which second current sinking branch is provided with a second control input, and means for controlling the currents through the first and second current sinking branches, which controlling means are coupled to the first and second control inputs respectively.

The present invention also concerns a telecommunication device provided with a current distribution circuit.

Such a current distribution circuit and device are known from application note ETT/AN93015 on the TEA 1093 chip. In particular this note discloses a current distribution circuit comprising:

a first AC and DC current sinking branch, which is provided with the series arrangement of the main current stream of a first current controlled semiconductor having a first combined AC/DC current control input, and a stabilising circuit for providing a DC supply voltage, a second AC current sinking branch connected in parallel to the series arrangement of the first current sinking branch, which second current sinking branch is provided with a second AC current control input, and means for controlling said currents through the first and second current sinking branches, which controlling means are coupled to the first and second current control inputs respectively.

Such a current distribution circuit is being applied in telecommunication devices, such as for example a subscriber telephone, a handsfree telephone, a facsimile, a WEB-television having a telephone card, a personal computer having a telephone card etc. Usually such telephone ICs' are capable of controlling the AC-speech signals on the telephone line to facilitate communication between the telecommunication device and a central device. Furthermore they are equipped for processing the DC-line-current from the telephone line in the first current sinking branch. The stabilising circuit provides the DC supply voltage having a relative high magnitude. Processing a necessary maximum DC-line-current in the first current sinking branch of say for example approximately 140 mA would lead to an IC having a relatively large chip area for the DC current controlled semi-conductor transistor used in that first current sinking branch, because said transistor has to have a certain limited collector/emitter voltage. This collector/emitter voltage is limited and has to be kept limited because the DC supply voltage needs to have a relative high magnitude for controlling present day telephone add-on equipment, such as handsfree facilities, extra loudspeakers, and other peripheral devices.

SUMMARY OF THE INVENTION

It is an object of the present invention to sink the necessary maximum DC-line-current at all times under all operating conditions and with a minimal chip area.

Thereto the present invention is characterised in that the current distribution circuit comprises an at least DC current measuring means coupled to the controlling means for providing a measure for at least the DC-current in the first current sinking branch, and that the second current sinking branch is a second at least DC-current sinking branch whose second control input is connected to the controlling means for leading an excessive part of at least the DC-current through the second current sinking branch.

The idea underlying the present invention is that the first current sinking branch sinks a part of the line-current normally used for deriving a DC supply voltage there from, whereas the second current sinking branch is used to sink a surplus part of at least the DC-line-current. Because the second current sinking branch does not contain the stabilising circuit, sinking the surplus, excess or top-part of at least the DC-current of the first current sinking branch through the second current sinking branch can take place in said second current sinking branch at a relatively high collector/emitter voltage. As a consequence thereof the chip area for taking up such a relatively high magnitude of DC current at larger collector/emitter voltages is reduced.

A further advantage of the current distribution circuit and device according to the invention is, that controlling the AC-currents in the first and second current sinking branches is still possible. In fact a possible simultaneous AC/DC current control in both the first current sinking branch and the second current sinking branch provides for a double control function in in particular the second current sinking branch.

BRIEF DESCRIPTION OF THE DRAWING

At present the invention will be elucidated further together with the additional advantages with reference to the accompanying drawing, wherein corresponding parts in the different figures are indicated by means of the same reference numerals. In the drawing.

DETAILED DESCRIPTION OF THE INVENTION

Figure 1:
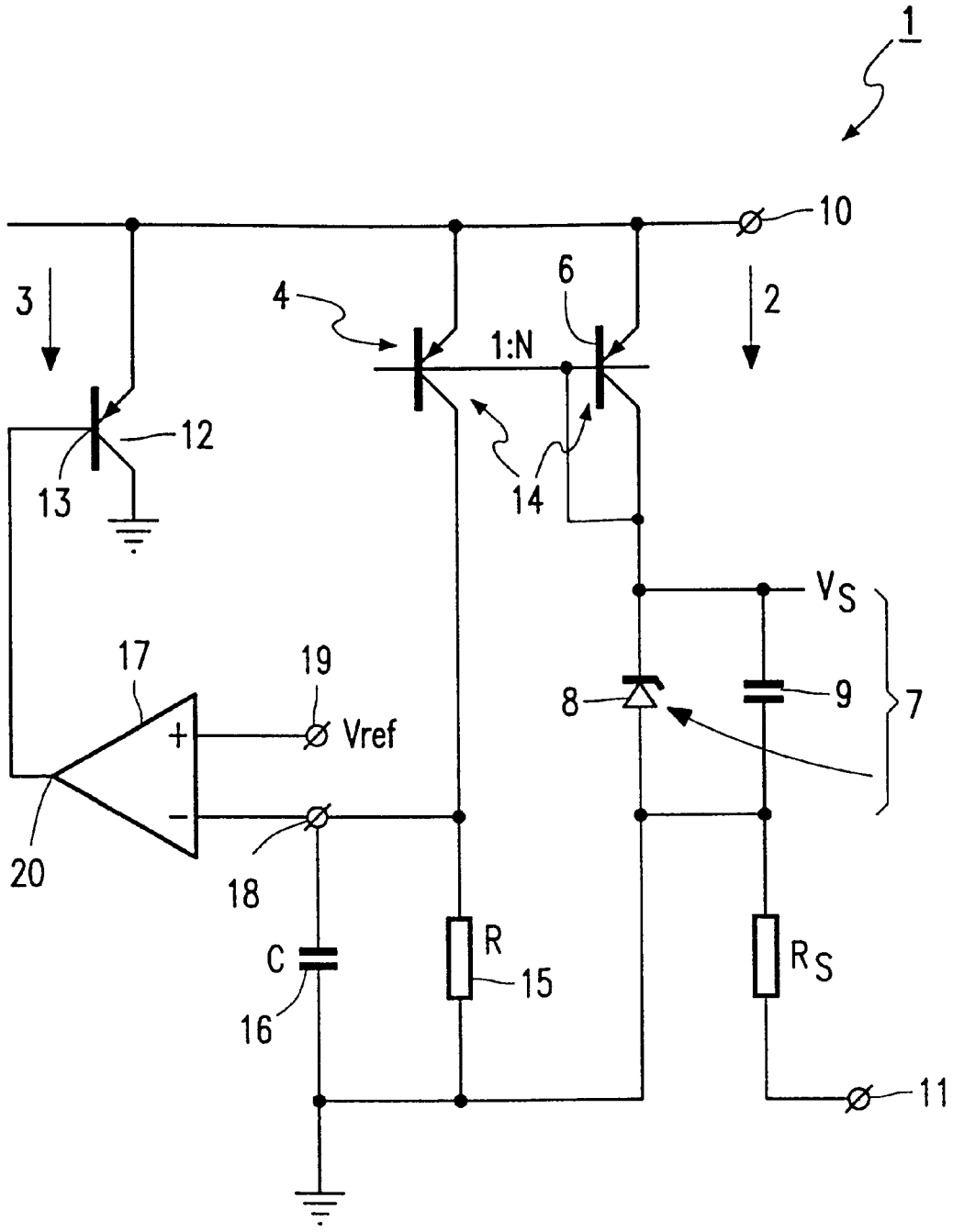
FIG. 1 shows a possible embodiment of the current distribution circuit according to the invention.

The schematic view of FIG. 1 shows a current distribution circuit 1, comprising a first DC current branch 2, a second current sinking branch 3 and means 4 for sensing at least the current through the first current sinking branch 2. In addition the current distribution circuit comprises means 5 (see FIG. 2) for controlling the AC current through branch 2. The first current sinking branch 2 comprises the series arrangement of a first for example current controlled semi-conductor transistor 6, and a circuit 7 which could for example be a stabilising circuit. The stabilising circuit 7 is shown to have a zenerdiode 8 connected in parallel to a capacitor 9 for supplying a supply voltage $V_S$. Resistor $R_s$ is a series resistor determining the voltage current slope between terminals 10 and 11. The schematically shown second current sinking branch 3 comprises a second for example current or voltage controlled semi-conductor transistor 12, provided with a control input 13. Furthermore the current distribution circuit 1 comprises an at least DC current measuring means, which is in this embodiment built up as a current mirror 14. Herewith the main current through the transistor 6 is mirrored into the transistor 4 by a ratio 1:N. The at least DC measuring means 14 is connected in series with a low pass filter 15, 16 whose RC value is chosen such, that frequencies of for example 5 Hz or lower are passed to a comparator means 17. The comparator has two inputs 18 and 19. Input 18 is connected to the low pass filter 15, 16, whereas input 19 is connected to a reference voltage $V_{ref}$ supplied by a DC voltage reference source (not shown). Furthermore the comparator 17 is provided with an output 20 connected to the control input 13 of the transistor 12. $V_{ref}$ is chosen such that the second current sinking branch 3 comes into operation in cases wherein it is necessary that an excess DC current above for example 40 mA flows through the second current sinking branch 3. Because of the larger collector/emitter voltage across the transistor 12 in the second current sinking branch its transistor chip area is lower than the chip area for a transistor which would be equipped to take up a similar current in cases wherein its collector/emitter voltage is lower. In an embodiment not further elucidated the information about the point whereon the second branch 3 has to come into operation, can also be deduced from the voltage across the series resistor, which resistor is connected in series with one of the line terminals 10 and 11.

Figure 2:
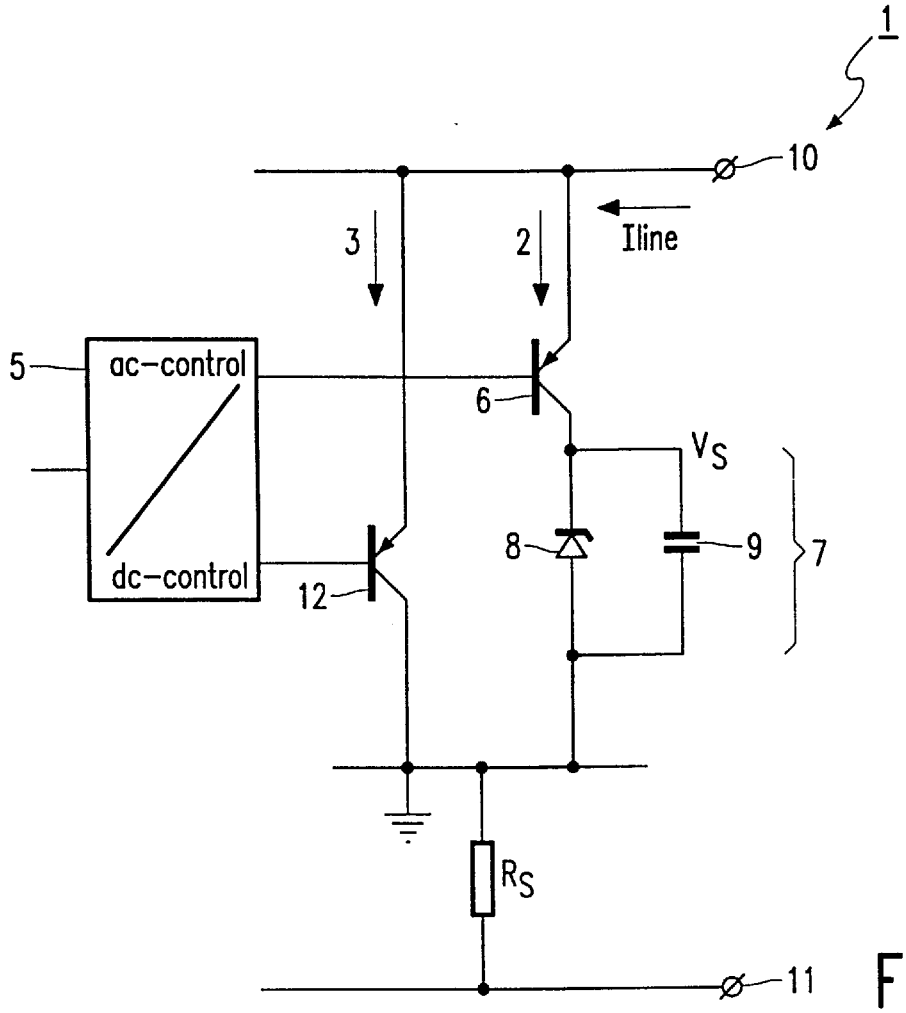
FIG. 2 shows a general outline of a further embodiment of the current distribution circuit according to the invention, and FIG. 3 schematically shows a telecommunication device provided with a current distribution circuit according to the present invention.

FIG. 2 shows a bloc schematic view of the various ways of controlling the AC and DC current through both branches 2 and 3. In a way known per se the AC control through branches 2 and 3 is such that in order to prevent distortion during large AC signals the second branch transistor 12 takes over the line-current on terminals 10, 11 during large AC signal excursions on the line 10, 11. Second branch transistor 12 will preferable sink the AC current during large AC signal excursions in addition to taking over a surplus part of the DC current in branch 2, in order to decrease the effectively needed chip area.

Figure 3:
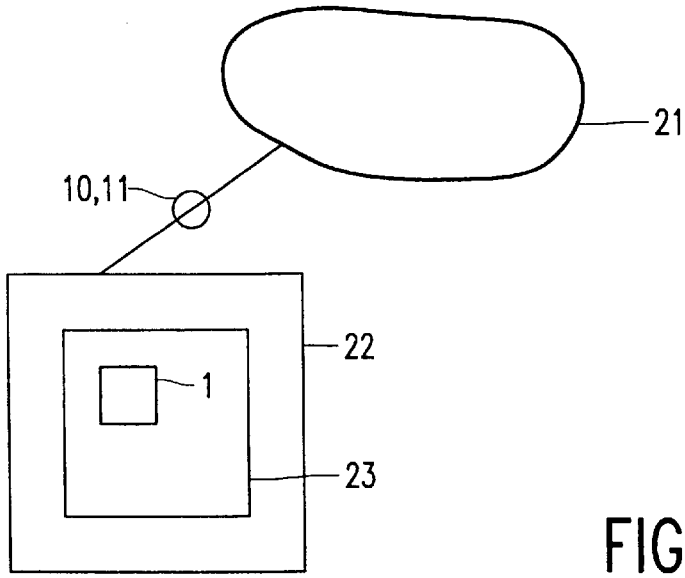

FIG. 3 schematically shows a network 21 connected through the line terminals 10, 11 to a telecommunication device 22 which is provided with a telephone set 23 having a current distribution circuit 1.

What is claimed is:

1. A current distribution circuit comprising:

a first current sinking branch, which is provided with a series arrangement of a main current stream of a first controlled semiconductor having a first control input, and of a circuit for providing a DC supply voltage, a second current sinking branch connected in parallel to the series arrangement, which second current sinking branch is provided with a second control input, wherein the first and second current sinking branches support at least DC current, means for controlling currents through the first and second current sinking branches, which controlling means is coupled between the first and second control inputs, and an at least DC current measuring means for providing a measure for at least a DC-current in the first current sinking branch, the at least DC current measuring means being coupled between the first control input and the controlling means, the second control input being connected to an output of the controlling means, and the controlling means being arranged to control leading an excessive part of at least the DC-current in the main current stream through the second current sinking branch, the first and second current sinking branches thereby substantially distributing a total current provided to the current distribution circuit.

2. The current distribution circuit according to claim 1, wherein the controlling means comprises a comparator coupled to the at least DC current measuring means and to a reference source for determining whether the DC current in the first current sinking branch is above a given threshold, the second current sinking branch coming into operation if the DC current is above the given threshold.

3. The current distribution circuit according to claim 2, wherein the at least DC current measuring means comprises a low pass filter.

4. The current distribution circuit according to claim 1, wherein the at least DC current measuring means comprises a second controlled semiconductor that forms a current mirror with the first controlled semiconductor, the first semiconductor mirroring a fraction of a current through the main current stream of the first controlled semiconductor into a main current stream of the second controlled semiconductor.

5. The current distribution circuit as claimed in claim 1, wherein the circuit for providing the DC supply voltage is a voltage stabilizer circuit.

6. The telecommunication device as claimed in claim 1, wherein the at least DC current measuring means comprises a second controlled semiconductor that forms a current mirror with the first controlled semiconductor, the first semiconductor mirroring a fraction of a current through the main current stream of the first controlled semiconductor into a main current stream of the second controlled semiconductor.

7. A telecommunication device with a current distribution circuit, said current distribution circuit comprising:

a first current sinking branch including a main current stream of a first controlled semiconductor device, said first current sinking branch having a first control input;

a second current sinking branch connected in parallel to the first current sinking branch, said second current sinking branch having a second control input, said first and second current sinking branches being DC and AC current sinking branches;

means for controlling DC and AC currents through said first and second current sinking branches, said controlling means being coupled to said first and second control inputs, and an at least DC current measuring means coupled to the controlling means for providing a measure for at least a DC-current in said first current sinking branch, said second control input being connected to said controlling means for leading an excessive part of at least said DC-current through the second current sinking branch.

8. A telecommunication device comprising:

a current distribution circuit including:

a first current sinking branch, which is provided with a series arrangement of a main current stream of a first controlled semiconductor having a first control input, and of a circuit for providing a DC supply voltage, a second current sinking branch connected in parallel to the series arrangement, which second current sinking branch is provided with a second control input, wherein the first and second branches support at least DC current;

means for controlling currents through the first and second current sinking branches, which controlling means is coupled between the first and second control inputs; and an at least DC current measuring means for providing a measure for at least a DC-current in the first current sinking branch, the at least DC current measuring means being coupled between the first control input and the controlling means, the second control input being connected to an output of the controlling means, and the controlling means being arranged to control leading an excessive part of at least the DC-current in the main current stream through the second current sinking branch, the first and second current sinking branches thereby substantially distributing a total current provided to the current distribution circuit.

9. The telecommunication device according to claim 8, wherein the telecommunication device is selected from the group consisting of a telephone, personal computer, facsimile, and Web-television.

10. The telecommunication device as claimed in claim 8, wherein the at least DC current measuring means comprises a low pass filter.

11. The telecommunication device as claimed in claim 8, wherein the first and second current sinking branches are formed as DC and AC current sinking branches, and the means for controlling the current through the first and second current sinking branches are means for controlling the AC and DC currents through the first and second current sinking branches.

12. The telecommunication device as claimed in claim 8, wherein the controlling means comprises a comparator coupled to the at least DC current measuring means and to a reference source for determining whether the DC current in the first current sinking branch is above given threshold, the second current sinking branch coming into operation if the DC current is above the given threshold.

13. A current distribution circuit comprising:

a first current sinking branch, which is provided with a series arrangement of a main current stream of a first controlled semiconductor having a first control input, of a circuit for providing a DC supply voltage, and of a line-current resistor;

a second current sinking branch connected in parallel to the series arrangement, which second current sinking branch is provided with a second control input, wherein the first and second current sinking branches support at least DC current;

means for controlling currents through the first and second current sinking branches, which controlling means is coupled to the first and second control inputs; and an at least DC current measuring means for providing a measure for at least a DC-current in the first current sinking branch, the at least DC current measuring means comprising the line-current resistor, and the controlling means being arranged to control, in response to the measure for at least a DC-current in the first current sinking branch, leading an excessive part of at least the DC-current in the main current stream through the second current sinking branch, the first and second current sinking branches thereby substantially distributing a total current provided to the current distribution circuit.

14. A current distribution circuit comprising:

a first current sinking branch including a main current stream of a first controlled semiconductor device, said first current sinking branch having a first control input;

a second current sinking branch connected in parallel to the first current sinking branch, said second current sinking branch having a second control input, said first and second current sinking branches being DC and AC current sinking branches;

means for controlling DC and AC currents through said first and second current sinking branches, said controlling means being coupled to said first and second control inputs, and an at least DC current measuring means coupled to the controlling means for providing a measure for at least a DC-current in said first current sinking branch, said second control input being connected to said controlling means for leading an excessive part of at least said DC-current through the second current sinking branch.

15. A current distribution circuit as claimed in claim 14, wherein said at least DC current measuring means comprises a low pass filter.

16. A current distribution circuit as claimed in claim 14, wherein said at least DC current measuring means comprises a second controlled semiconductor device that forms a current mirror with said first controlled semiconductor device, said first controlled semiconductor device mirroring a fraction of a current through said main current stream of said first controlled semiconductor device into a main current stream of said second controlled semiconductor device.

* * * * *